US009375379B1

(12) United States Patent
Morier

(10) Patent No.: US 9,375,379 B1
(45) Date of Patent: Jun. 28, 2016

(54) CRUTCH EXTENSION UPPER BODY SUPPORT ASSEMBLY

(71) Applicant: Jean-Paul Morier, Victorville, CA (US)

(72) Inventor: Jean-Paul Morier, Victorville, CA (US)

( * ) Notice: Subject to any disclaimer, the term of this patent is extended or adjusted under 35 U.S.C. 154(b) by 0 days.

(21) Appl. No.: 14/806,668

(22) Filed: Jul. 23, 2015

Related U.S. Application Data

(60) Provisional application No. 62/168,911, filed on Jun. 1, 2015.

(51) Int. Cl.
*A61H 3/02* (2006.01)
*A61H 3/00* (2006.01)

(52) U.S. Cl.
CPC ..... *A61H 3/008* (2013.01); *A61H 3/02* (2013.01); *A61H 2003/007* (2013.01); *A61H 2201/1652* (2013.01)

(58) Field of Classification Search
CPC ..... A61H 3/008; A61H 2003/007; A61H 2201/16; A61H 2201/165; A61H 2201/1652
See application file for complete search history.

(56) References Cited

U.S. PATENT DOCUMENTS 2,459,066 A * 1/1949 Duke ..... A61H 3/04 297/215.13
2,719,568 A * 10/1955 Webb ..... A61H 3/008 2/69
3,778,052 A * 12/1973 Andow ..... A61H 3/008 135/67
4,245,659 A * 1/1981 Shofner ..... A61H 3/02 135/68
5,165,436 A * 11/1992 Hall, Sr. ..... A61H 3/02 135/66
5,224,924 A * 7/1993 Urso ..... A61F 5/024 135/71
5,348,035 A * 9/1994 Porter ..... A61H 3/02 135/66
5,664,713 A * 9/1997 Burgstahler ..... A45F 3/14 135/66
5,673,719 A * 10/1997 Shofner ..... A61H 3/02 135/68
5,755,644 A * 5/1998 Breems ..... A61H 3/02 135/68
5,787,898 A * 8/1998 Freimann ..... A61H 1/0229 128/898
5,868,694 A * 2/1999 Marlow ..... A61F 5/026 602/19
5,911,234 A * 6/1999 Hirst ..... A61H 3/02 119/770
6,059,697 A * 5/2000 Breems ..... A61H 3/02 135/68
6,637,547 B1 10/2003 Wydner
6,675,820 B2 * 1/2004 Balan ..... A61H 3/008 135/67
6,935,353 B2 * 8/2005 Hawkes ..... A61H 3/008 135/67
8,146,614 B2 4/2012 Ford et al.
2009/0114692 A1 * 5/2009 Roman ..... A45F 3/14 224/660
2009/0235436 A1 9/2009 Baldesare
2015/0018739 A1 * 1/2015 Threlfall ..... A61H 3/02 602/23

FOREIGN PATENT DOCUMENTS

WO WO 9719611 A1 * 6/1997 ..... A61H 3/008

* cited by examiner

*Primary Examiner* — David R Dunn
*Assistant Examiner* — Danielle Jackson

(57) ABSTRACT

A crutch extension upper body support assembly is provided. The crutch extension upper body support assembly includes a crutch extension member secured to rails of a crutch by a locking mechanism. The locking mechanism includes an inner plate having a pair of vertical channels for receiving the rails of the crutch. A hollow tubular member on the inner plate is adapted to receive the crutch extension member and an outer plate is affixed to the inner plate for securing the locking mechanism and the crutch extension member in place. A harness may be placed on the upper torso of an individual and attached to one or more crutch extension members by a pair of loops located on shoulder straps of the harness. When adjusted properly, placing the loops onto the one or more crutch extension members causes the weight of an individual to be distributed throughout the entire upper body.

19 Claims, 8 Drawing Sheets

CRUTCH EXTENSION UPPER BODY SUPPORT ASSEMBLY

CLAIM OF PRIORITY

The present Application for Patent claims priority to U.S. Provisional Application No. 62/168,911 entitled "BACK SUPPORT ATTACHMENT FOR CRUTCH", filed Jun. 1, 2015, which is hereby expressly incorporated by reference.

FIELD

The present invention relates to an attachment for a crutch and more specifically to a crutch extension upper body support assembly which is utilized to lift the upper body of an individual upward.

BACKGROUND

If an injury or surgery requires an individual to get around without putting any weight on his or her leg or foot, the individual may have to use crutches, such as under arm crutches or forearm crutches. Under arm crutches include a pad that is held under the arm and pressed into the side of an individual. Forearm crutches include a cuff at the top to go around the forearm. The forearm crutch is used by inserting the arm into a cuff and holding the grip. The cuff can be a half-circle or a full circle with a V-type opening in the front allowing the forearm to slip out in case of a fall.

Under arm and forearm crutches require tremendous amount of upper body and hand strength for use. It is a popular misconception that the arms of an individual alone hold the body weight when using crutches. This misconception and improper usage of the crutches can cause an individual to hunch over creating bad posture as well as other medical problems.

What is needed is an attachment that can be utilized with a crutch that causes the weight of an individual using the crutches to be distributed throughout the entire upper body and as such, the muscles of the trunk and shoulders do just as much work as the arms.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a crutch extension upper body support assembly for securing to a crutch is provided. The crutch extension upper body support assembly may include a crutch extension member, a locking mechanism and a harness. The crutch extension member may include a lower arm extending along a first longitudinal axis; an elongated arm extending along an axis perpendicular to the first longitudinal axis; and an upper arm extending along a second longitudinal axis. The locking mechanism may include a hollow tubular member detachably securing the lower arm of the crutch extension member to the crutch. The harness may include a first vertical strap having a first loop and a second vertical loop having a second loop, the first loop adapted to receive the upper arm of the crutch extension member.

According to one aspect, the locking mechanism may further comprise an inner side plate having an upper edge and an opposing lower edge, a pair of vertical channels extending from the upper edge to the lower edge and sized to receive a pair of side rails of the crutch; a platform extending perpendicularly outward from the upper edge of the inner side plate, the hollow tubular member located on the platform; and an outer side plate detachably secured to the inner side plate.

According to another aspect, the outer side plate is secured to the inner side plate by at least one threaded knob inserted through at least one outer side plate hole and at least one inner side plate hole.

According to yet another aspect, the elongated arm of the crutch extension member comprises a first elongated arm portion extending perpendicularly upward from a distal end of the lower arm; a second elongated arm portion integrally connected to and extending perpendicularly outward from the first elongated arm portion; and a third elongated arm portion integrally connected to and extending upwardly from the second elongated arm portion.

According to yet another aspect, the third elongated arm portion is connected to a distal end of the upper arm.

According to yet another aspect, the connection between the third elongated arm portion and the distal end of the upper arm has a curvilinear shape.

According to yet another aspect, the first elongated arm portion is located in a first vertical axis and the third elongated arm portion is located in a second vertical axis; and wherein the first vertical axis is parallel to the second vertical axis.

According to yet another aspect, the first vertical axis is located in a first vertical plane and the second vertical axis is located in a second vertical plane; and wherein the first vertical plane is different than the second vertical plane.

According to yet another aspect, the first vertical plane is separated from the second vertical plane by a length of the second elongated arm portion.

According to yet another aspect, the first longitudinal axis is parallel to the second longitudinal axis.

According to yet another aspect, the first longitudinal axis is located in a first plane and the second longitudinal axis is located in a second plane; and wherein the first plane is different than the second plane.

According to yet another aspect, the harness further comprises a first horizontal strap secured to the first and second vertical straps and located in a first horizontal plane; and a second horizontal strap secured to the first and second vertical straps and located in a second horizontal plane; and wherein the first horizontal plane is parallel to the second horizontal plane.

According to yet another aspect, the harness further comprises a first extension strap secured to the first vertical strap, where the first loop is slidingly engageable to the first extension strap; and a second extension strap secured to the second vertical strap, wherein the second loop is slidingly engageable to the second extension strap.

According to another feature, a crutch extension upper body support assembly for securing to a crutch is provided. The crutch extension upper body support assembly includes a crutch extension member, a locking mechanism and a harness. The crutch extension member includes a lower arm extending along a first longitudinal axis; an elongated arm extending along an axis perpendicular to the first longitudinal axis; and an upper arm extending along a second longitudinal axis. The locking mechanism includes an inner side plate having an upper edge and an opposing lower edge, a pair of vertical channels extending from the upper edge to the lower edge and sized to receive a pair of side rails of the crutch; a platform extending perpendicularly outward from the upper edge of the inner side plate; a hollow tubular member located on the platform detachably securing the lower arm of the crutch extension member to the crutch; and an outer side plate detachably secured to the inner side plate. The harness includes a first vertical strap having a first loop and a second vertical loop having a second loop, the first loop adapted to receive the upper arm of the crutch extension member.

According to one feature, the outer side plate is secured to the inner side plate by at least one threaded knob inserted through at least one outer side plate hole and at least one inner side plate hole.

According to another feature, the elongated arm of the crutch extension member comprises a first elongated arm portion extending perpendicularly upward from a distal end of the lower arm; a second elongated arm portion integrally connected to and extending perpendicularly outward from the first elongated arm portion; and a third elongated arm portion integrally connected to and extending upwardly from the second elongated arm portion.

According to yet another feature, the third elongated arm portion is connected to a distal end of the upper arm.

According to yet another feature, the connection between the third elongated arm portion and the distal end of the upper arm has a curvilinear shape.

According to yet another feature, the first elongated arm portion is located in a first vertical axis and the third elongated arm portion is located in a second vertical axis; and wherein the first vertical axis is parallel to the second vertical axis.

According to yet another feature, the first vertical axis is located in a first vertical plane and the second vertical axis is located in a second vertical plane; and wherein the first vertical plane is different than the second vertical plane.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION OF THE INVENTION

In the following description, specific details are given to provide a thorough understanding of the embodiments. However, it will be understood by one of ordinary skill in the art that the embodiments may be practiced without these specific details.

Overview

The present disclosure provides a crutch extension upper body support assembly for use with a typical crutch. The crutch extension upper body support assembly may include a crutch extension member secured to rails of a crutch by a locking mechanism. The locking mechanism may include an inner plate having a pair of vertical channels sized and adapted to receive the rails of the crutch. A hollow tubular member located on the inner plate may be sized and adapted to receive the crutch extension member. An outer plate may be affixed to the inner plate for securing the locking mechanism and the crutch extension member in place. A harness may be placed on the upper torso of an individual and attached to one or more crutch extension members by a pair of loops located on shoulder straps of the harness. When adjusted properly, placing the loops onto the one or more crutch extension members causes the weight of an individual using the crutches to be distributed throughout the entire upper body and as such, the muscles of the trunk and shoulders do just as much work as the arms.

Typical Crutch

Figure 1:
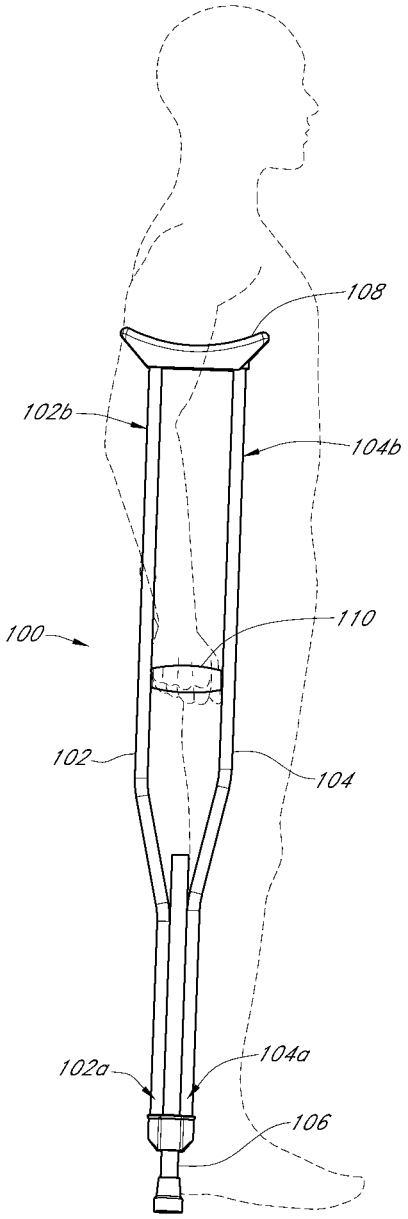
FIG. 1 illustrates a side elevation view of typical crutch in relation to a user.

FIG. 1 illustrates a side elevation view of typical crutch 100 in relation to a user. The crutch 100 includes a pair of side rails 102, 104 having lower ends 102*a*, 104*a* connected by a leg joint 106 and upper ends 102*b*, 104*b* connected by an under-arm support member 108. A hand bar 110 may be adjustably located between the pair of side rails 102, 104.

Crutch Extension Upper Body Support Assembly

Figure 2:
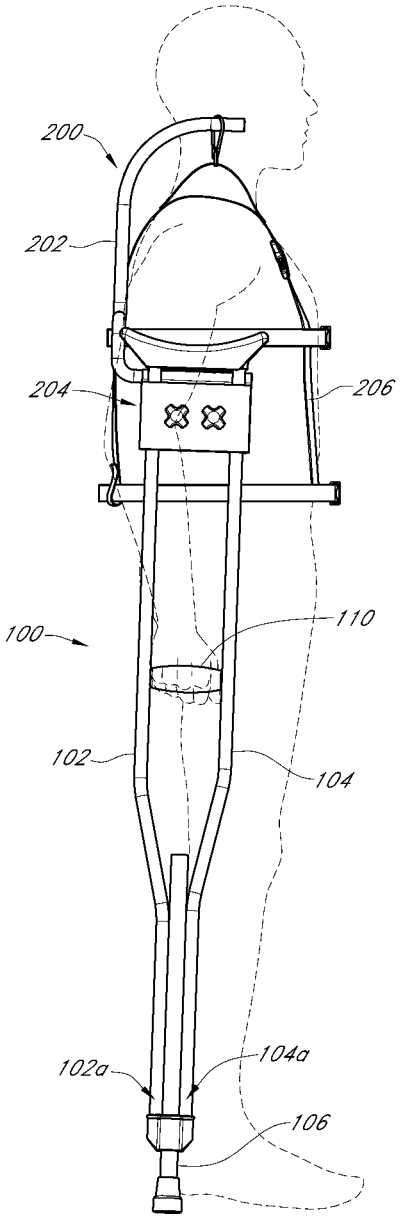
FIG. 2 illustrates a side elevation view of a typical crutch with a crutch extension upper body support assembly of the present disclosure in relation to a user.
Figure 3:
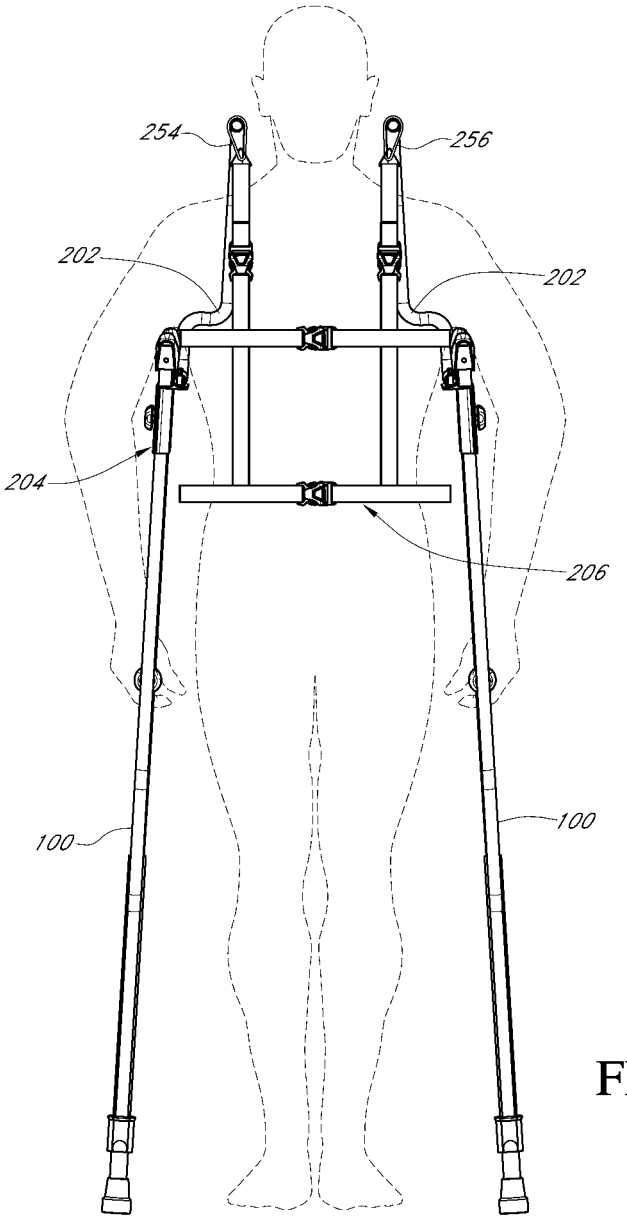
FIG. 3 illustrates a front elevation view of a pair of typical crutches with a crutch extension upper body support assembly of the present disclosure in relation to a user.
Figure 4:
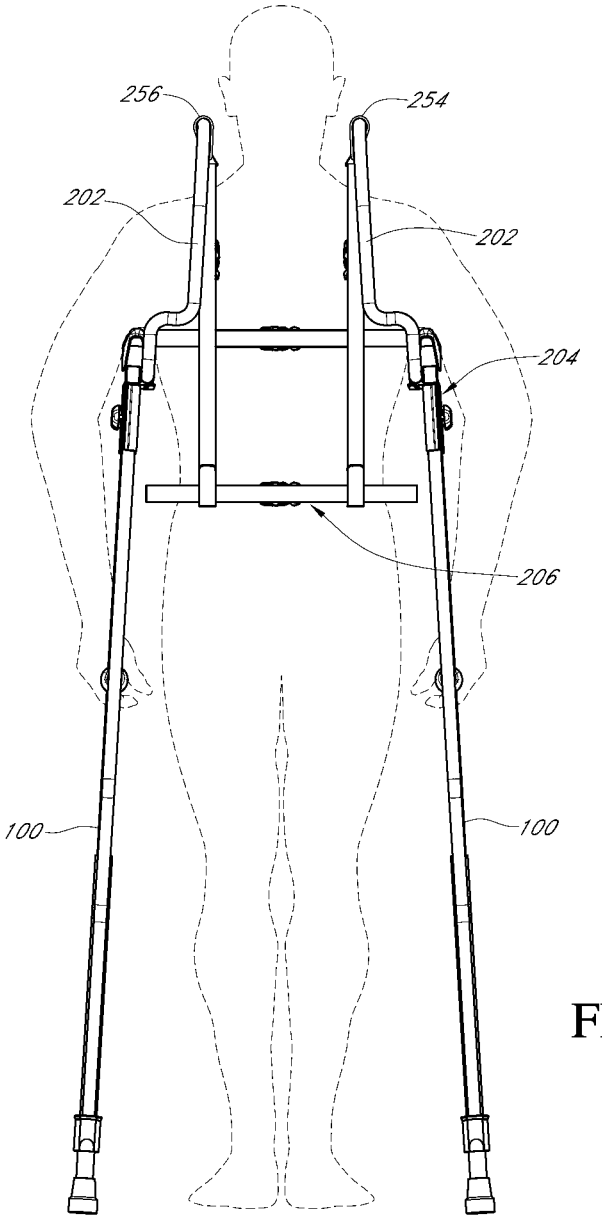
FIG. 4 illustrates a back elevation view of a pair of typical crutches with a crutch extension upper body support assembly of the present disclosure in relation to a user.
Figure 5:
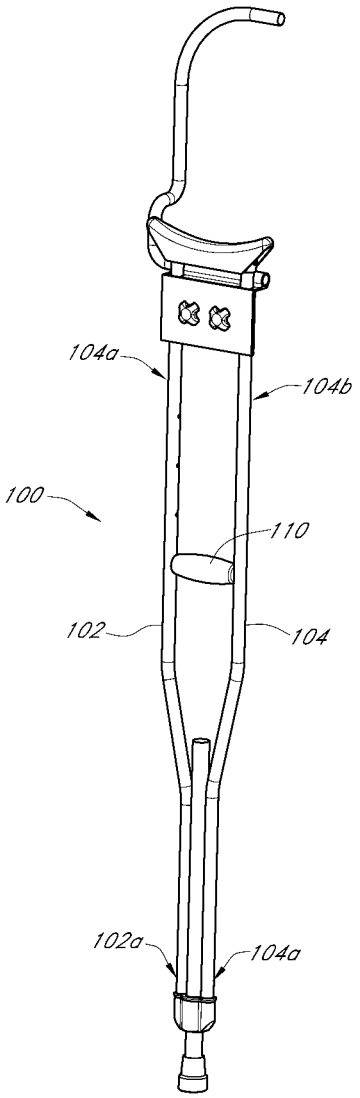
FIG. 5 illustrates a side perspective view of a typical crutch having a portion of the crutch extension upper body support assembly of the present disclosure attached thereon.
Figure 6:
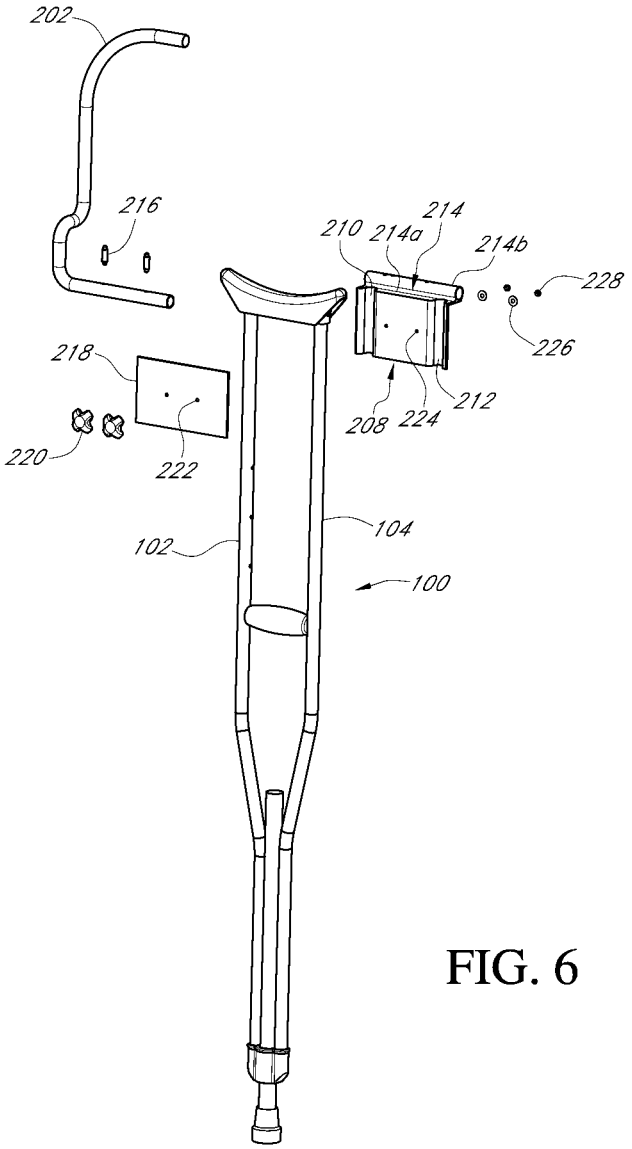
FIG. 6 illustrates an exploded view of the portion of the crutch extension upper body support assembly of FIG. 5.
Figure 7:
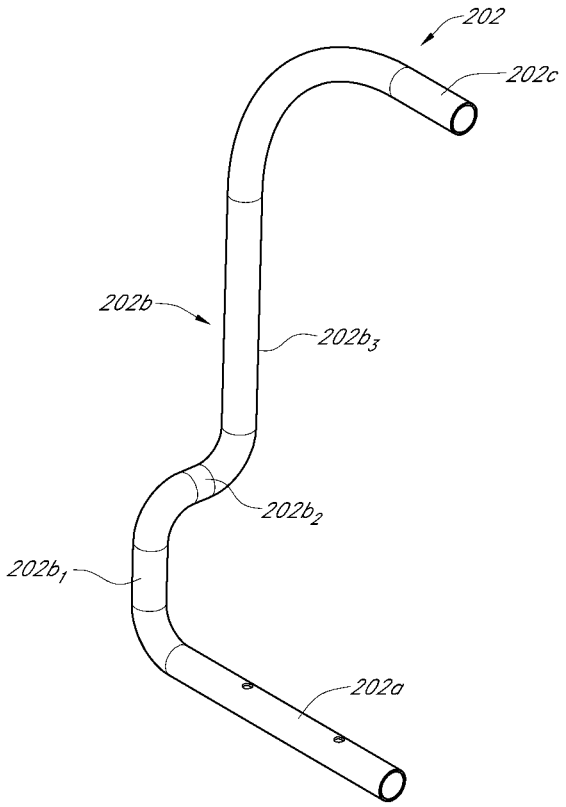
FIG. 7 illustrates a crutch extension member of the crutch extension upper body support assembly of the present disclosure.
Figure 8:
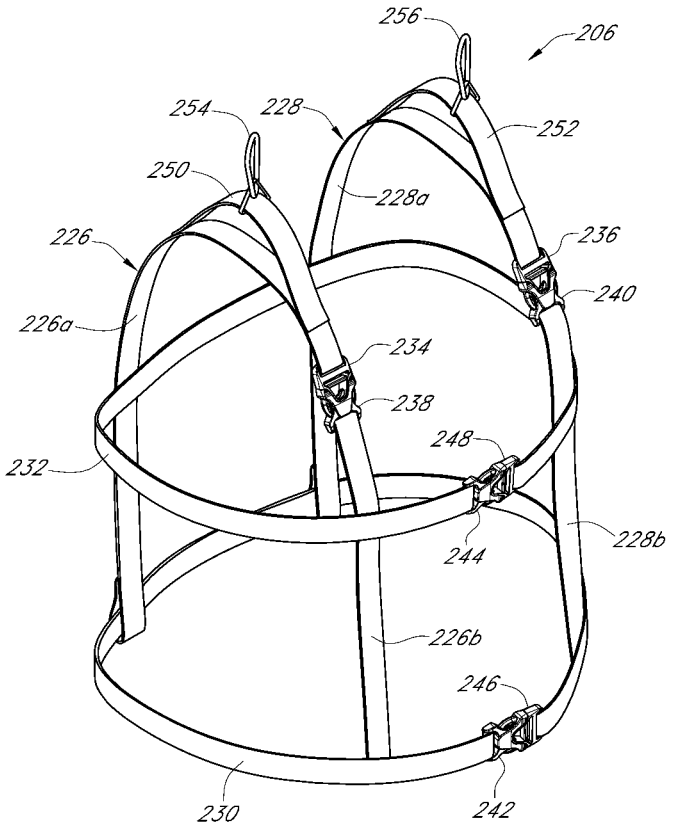
FIG. 8 illustrates a harness of the crutch extension upper body support assembly of the present disclosure.

FIG. 2 illustrates a side elevation view of a typical crutch 100 with a crutch extension upper body support assembly 200 of the present disclosure in relation to a user. FIG. 3 illustrates a front elevation view of a pair of typical crutches with the crutch extension upper body support assembly of the present disclosure in relation to a user. FIG. 4 illustrates a back elevation view of a pair of typical crutches with the crutch extension upper body support assembly of the present disclosure in relation to a user. FIG. 5 illustrates a side perspective view of a typical crutch having a portion of the crutch extension upper body support assembly of the present disclosure attached thereon. FIG. 6 illustrates an exploded view of the portion of the crutch extension upper body support assembly of FIG. 5. FIG. 7 illustrates a crutch extension member of the crutch extension upper body support assembly of the present disclosure. FIG. 8 illustrates a harness of the crutch extension upper body support assembly of the present disclosure. The following discussion refers interchangeably to FIGS. 2-8.

As shown, the crutch extension upper body support assembly 200 may include at least one crutch extension member 202, a locking mechanism 204 for detachably securing the crutch extension member 202 to the rails of a crutch 100 and a harness 206 for securing the user to the crutch extension upper body support assembly.

As shown in FIG. 6, the locking mechanism 204 may include an inner side plate 208 having an upper edge and an opposing lower edge. A pair of vertical channels 210, 212 may be located in the inner side plate 208 extending from the upper edge to the lower edge and sized to receive the side rails 102, 104 of the crutch 100. A platform 214 may be secured to an upper edge of the inner side plate 208. The platform 214 may include an upper horizontal plate 214*a* extending perpendicularly outward from the upper edge of the inner side plate 208 and a hollow tubular member 214*b* adapted and sized to receive a lower arm 202*a* of the crutch extension member 202 as described in further detail below.

The end of the crutch extension member 202 may be removably secured within the hollow tubular member 214*b* by one or more screws 216. The locking mechanism 204 may further include an outer side plate 218 detachably secured to the inner side plate 208. According to one aspect, the outer side plate 218 may be detachably secured to the inner side plate 208 by inserting threaded knobs 220 through holes 222 located in the outer side plate 218 which align with holes 224 in the inner side plate 208 and secured using washers 226 and nuts 228 as known in the art. Although screws, nuts and washers are shown, this is by way of example only and any method of securing the outer side plate 218 to the inner side plate may be utilized.

By utilizing threaded knobs 220 (or other fixtures), the user can easily loosen or release the outer side plate 218 from the inner side plate 208 allowing the crutch extension member 202 to be adjusted for the specific height of the user.

According to one aspect, as shown in FIG. 7, the crutch extension member 202 may include a lower arm 202*a* extending along a first longitudinal axis, an elongated arm 202*b* extending along an axis perpendicular to the first longitudinal axis and an upper arm 202*c* extending along a second longitudinal axis. According to one aspect, the first longitudinal axis may be parallel to the first longitudinal axis but located in different planes.

According to one aspect, the elongated arm 202*b* may include a first elongated arm portion $\mathbf{202}b_1$ extending perpendicularly upward from a distal end of the lower arm 202*a*, a second elongated arm portion $\mathbf{202}b_2$ integrally connected to and extending generally perpendicularly outward from the first elongated arm portion $\mathbf{202}b_1$, and a third elongated arm portion $\mathbf{202}b_3$ integrally connected to and extending upwardly from the second elongated arm portion $\mathbf{202}b_2$.

The first elongated arm portion $\mathbf{202}b_1$ may be located in a first vertical axis and the third elongated arm portion $\mathbf{202}b_3$ may be located in a second vertical axis. According to one aspect, the first vertical axis may be parallel to the second vertical axis. Furthermore, the first vertical axis may be located in a first vertical plane and the second vertical axis may be located in a second vertical plane. The first vertical plane may be different than the second vertical plane.

According to one aspect, the connection between the third elongated arm portion $\mathbf{202}b_3$ may have a curvilinear shape for extending over the shoulder of a user.

As shown in FIG. 8, the harness 206 may include a first vertical strap 226 and a second vertical strap 228. Each vertical strap 226, 228 may include a first portion 226*a*, 228*a* having a first end, mid-section and a second end and a second portion 226*b*, 228*b* having a first end and a second end. According to one aspect, the first ends of the first portions 226*a*, 228*a* may form loops for receiving a first horizontal strap 230 and a second horizontal strap 232 may be secured to the mid-sections of the first portions 226*a*, 228*a*. The second horizontal strap 232 may be fixedly attached to the mid-sections of the first portions 226*a*, 228*a* or alternatively, the mid-sections of the first portions 226*a*, 228*a* may include loops adapted to receive the second horizontal strap 232. The loops at the first ends of the first portions 226*a*, 228*a* may preferably be at the level of the waist of the user while the loops at the mid-sections of the first portions 226*a*, 228*a* may preferably be at the level of the chest of the user.

According to one aspect, the second ends of the first portions 226*a*, 228*a* may be slidably and reversibly attached to clips 234, 236. The clips 234, 236 may be inserted into clasps 238, 240 affixed to the first ends of the second portions 226*b*, 228*b* of the first and second vertical straps 226, 228 forming buckles. The second ends and the mid-sections of the second portions 226*b*, 228*b* of the first and second vertical straps 226, 228 may be affixed to the first and second horizontal straps 230, 232 respectively. The first and second vertical straps 226, 228 are adjustable allowing the harness to be sized to each individual as well as lifting the upper body of an individual upward.

According to one aspect, the first ends of the first and second horizontal straps 230, 232 may be slidably and reversibly attached to clasps 242, 244 while the second ends of the first and second horizontal straps 230, 232 may be slidably and reversibly attached to clips 246, 248. The clips 246, 248 may be inserted into the clasps 242, 244 forming buckles. The first and second horizontal straps 230, 232 are adjustable allowing the harness to be sized to each individual.

According to one aspect, a first extension strap 250 may be secured to the first portion 226*a* of the first vertical strap 226 and a second extension strap 252 may be secured to the first portion 228*a* of the second vertical strap 228. A first loop 254 may be secured to the first extension strap 250 and a second loop 256 may be secured to the first extension strap 250. The first and second loops 254, 256 may be placed around the upper arm 202*c* of the crutch extension member 202 causing the weight of an individual using the crutches to be distributed throughout the entire upper body.

According to one aspect, the straps of the harness may be constructed of any type of durable and flexible material.

According to one aspect, the crutch extension member may be made from metal, plastic, carbon fiber or any other suitable material known in the art.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A crutch extension upper body support assembly for securing to a crutch, comprising:

a crutch extension member comprising:

a lower arm extending along a first longitudinal axis;

an elongated arm extending along an axis perpendicular to the first longitudinal axis, the elongated arm comprising:

a first elongated arm portion extending perpendicularly upward from a distal end of the lower arm;

a second elongated arm portion integrally connected to and extending perpendicularly outward from the first elongated arm portion; and a third elongated arm portion integrally connected to and extending upwardly from the second elongated arm portion; and an upper arm extending along a second longitudinal axis;

a locking mechanism comprising a hollow tubular member detachably securing the lower arm of the crutch extension member to the crutch; and a harness comprising a first vertical strap having a first loop and a second vertical loop having a second loop, the first loop adapted to receive the upper arm of the crutch extension member.

2. The crutch extension upper body support assembly of claim 1, wherein the locking mechanism further comprises:

an inner side plate having an upper edge and an opposing lower edge, a pair of vertical channels extending from the upper edge to the lower edge and sized to receive a pair of side rails of the crutch;

a platform extending perpendicularly outward from the upper edge of the inner side plate, the hollow tubular member located on the platform; and an outer side plate detachably secured to the inner side plate.

3. The crutch extension upper body support assembly of claim 2, wherein the outer side plate is secured to the inner side plate by at least one threaded knob inserted through at least one outer side plate hole and at least one inner side plate hole.

4. The crutch extension upper body support assembly of claim 1, the third elongated arm portion is connected to a distal end of the upper arm.

5. The crutch extension upper body support assembly of claim 4, wherein the connection between the third elongated arm portion and the distal end of the upper arm has a curvilinear shape.

6. The crutch extension upper body support assembly of claim 4, wherein the first elongated arm portion extends along a first vertical axis and the third elongated arm portion extends along a second vertical axis; and wherein the first vertical axis is parallel to the second vertical axis.

7. The crutch extension upper body support assembly of claim 6, wherein the first vertical axis is located in a first vertical plane and the second vertical axis is located in a second vertical plane; and wherein the first vertical plane is different than the second vertical plane.

8. The crutch extension upper body support assembly of claim 7, wherein the first vertical plane is separated from the second vertical plane by a length of the second elongated arm portion.

9. The crutch extension upper body support assembly of claim 1, wherein the first longitudinal axis is parallel to the second longitudinal axis.

10. The crutch extension upper body support assembly of claim 9, wherein the first longitudinal axis is located in a first plane and the second longitudinal axis is located in a second plane; and wherein the first plane is different than the second plane.

11. The crutch extension upper body support assembly of claim 1, wherein the harness further comprises:

a first horizontal strap secured to the first and second vertical straps and located in a first horizontal plane; and a second horizontal strap secured to the first and second vertical straps and located in a second horizontal plane; and wherein the first horizontal plane is parallel to the second horizontal plane.

12. The crutch extension upper body support assembly of claim 1, wherein the harness further comprises:

a first extension strap secured to the first vertical strap, where the first loop is slidingly engageable to the first extension strap; and a second extension strap secured to the second vertical strap, wherein the second loop is slidingly engageable to the second extension strap.

13. A crutch extension upper body support assembly for securing to a crutch, comprising:

a crutch extension member comprising:

a lower arm extending along a first longitudinal axis;

an elongated arm extending along an axis perpendicular to the first longitudinal axis; and an upper arm extending along a second longitudinal axis;

a locking mechanism comprising:

an inner side plate having an upper edge and an opposing lower edge, a pair of vertical channels extending from the upper edge to the lower edge and sized to receive a pair of side rails of the crutch;

a platform extending perpendicularly outward from the upper edge of the inner side plate;

a hollow tubular member located on the platform detachably securing the lower arm of the crutch extension member to the crutch; and an outer side plate detachably secured to the inner side plate; and a harness comprising a first vertical strap having a first loop and a second vertical strap having a second loop, the first loop adapted to receive the upper arm of the crutch extension member.

14. The crutch extension upper body support assembly of claim 13, wherein the outer side plate is secured to the inner side plate by at least one threaded knob inserted through at least one outer side plate hole and at least one inner side plate hole.

15. The crutch extension upper body support assembly of claim 13, wherein the elongated arm of the crutch extension member comprises:

a first elongated arm portion extending perpendicularly upward from a distal end of the lower arm;

a second elongated arm portion integrally connected to and extending perpendicularly outward from the first elongated arm portion; and a third elongated arm portion integrally connected to and extending upwardly from the second elongated arm portion.

16. The crutch extension upper body support assembly of claim 15, the third elongated arm portion is connected to a distal end of the upper arm.

17. The crutch extension upper body support assembly of claim 16, wherein the connection between the third elongated arm portion and the distal end of the upper arm has a curvilinear shape.

18. The crutch extension upper body support assembly of claim 16, wherein the first vertical axis is located in a first vertical plane and the second vertical axis is located in a second vertical plane; and wherein the first vertical plane is different than the second vertical plane.

19. The crutch extension upper body support assembly of claim 15, wherein the first elongated arm portion extends along a first vertical axis and the third elongated arm portion extends along a second vertical axis; and wherein the first vertical axis is parallel to the second vertical axis.

* * * * *